US008144105B2

(12) United States Patent
Sumi

(10) Patent No.: US 8,144,105 B2
(45) Date of Patent: Mar. 27, 2012

(54) LCD WITH ADAPTIVE OVERDRIVE

(75) Inventor: Naoki Sumi, Hyogo (JP)

(73) Assignee: Chimei Innolux Corporation, Chu-Nan (TW)

( * ) Notice: Subject to any disclaimer, the term of this patent is extended or adjusted under 35 U.S.C. 154(b) by 305 days.

(21) Appl. No.: 12/627,177

(22) Filed: Nov. 30, 2009

(65) Prior Publication Data

US 2010/0134392 A1 Jun. 3, 2010

Related U.S. Application Data

(60) Provisional application No. 61/118,508, filed on Nov. 28, 2008.

(30) Foreign Application Priority Data

Aug. 3, 2009 (JP) ..... 2009-180956

(51) Int. Cl.
*G09G 3/36* (2006.01)

(52) U.S. Cl. ..... 345/101; 345/87; 345/42; 349/42

(58) Field of Classification Search ..... 345/30, 345/38, 39, 42, 50, 87, 204, 690, 208, 89, 345/94, 98–101
See application file for complete search history.

(56) References Cited

U.S. PATENT DOCUMENTS

2005/0068343 A1 3/2005 Pan et al.
2009/0267930 A1 10/2009 Sumi

*Primary Examiner* — Hoa T Nguyen
*Assistant Examiner* — Andrew Sasinowski
(74) *Attorney, Agent, or Firm* — Kirton McConkie; Evan R. Witt

(57) ABSTRACT

A LCD device includes a LCD module, a thermal sensor, an operating device and a frame memory. The operating device includes first and second comparators, one-dimensional first to fourth lookup tables and an operator. The LCD device further includes a selector/data-generator which differentially generates an overdrive output and a prediction output according to outputs of the first comparator, the second comparator and the operator, depending on one of four conditions including a first condition that a start level and an end level are consistent; a second condition that a level of the output of the operator is greater than a predefined maximum; a third condition that the level is less than a predefined minimum; and a fourth condition that the level lies between the predefined maximum and the predefined minimum.

6 Claims, 14 Drawing Sheets

| Start level | Predicted level | |
|---|---|---|
| | od=0 | od=63 |
| 0 | 0 | 4 |
| 1 | 0 | 7 |
| 2 | 1 | 9 |
| 3 | 1 | 11 |
| 4 | 2 | 14 |
| 5 | 2 | 16 |
| 6 | 3 | 18 |
| 7 | 3 | 20 |
| 8 | 4 | 23 |
| 9 | 5 | 24 |
| 10 | 5 | 25 |
| 11 | 6 | 26 |
| 12 | 7 | 27 |
| 13 | 8 | 29 |
| 14 | 9 | 30 |
| 15 | 9 | 31 |
| 16 | 9 | 32 |
| 17 | 10 | 33 |
| 18 | 11 | 34 |
| 19 | 12 | 35 |
| 20 | 13 | 36 |
| 21 | 14 | 37 |
| 22 | 14 | 38 |
| 23 | 15 | 39 |
| 24 | 16 | 40 |
| 25 | 17 | 41 |
| 26 | 17 | 42 |
| 27 | 18 | 43 |
| 28 | 19 | 44 |
| 29 | 19 | 45 |
| 30 | 20 | 45 |
| 31 | 21 | 46 |
| 32 | 21 | 47 |
| 33 | 22 | 48 |
| 34 | 23 | 49 |
| 35 | 24 | 49 |
| 36 | 25 | 50 |
| 37 | 26 | 51 |
| 38 | 27 | 51 |
| 39 | 27 | 52 |
| 40 | 28 | 53 |
| 41 | 29 | 53 |
| 42 | 30 | 54 |
| 43 | 30 | 54 |
| 44 | 31 | 55 |
| 45 | 32 | 55 |
| 46 | 33 | 56 |
| 47 | 33 | 56 |
| 48 | 34 | 57 |
| 49 | 35 | 57 |
| 50 | 36 | 57 |
| 51 | 37 | 58 |
| 52 | 38 | 58 |
| 53 | 39 | 59 |
| 54 | 40 | 59 |
| 55 | 40 | 60 |
| 56 | 41 | 60 |
| 57 | 43 | 61 |
| 58 | 44 | 61 |
| 59 | 46 | 61 |
| 60 | 47 | 62 |
| 61 | 49 | 62 |
| 62 | 50 | 63 |
| 63 | 51 | 63 |

FIG.4

LCD WITH ADAPTIVE OVERDRIVE

CROSS REFERENCE TO RELATED PATENT APPLICATION

This patent application claims the benefit of U.S. provisional patent application No. 61/118,508, filed Nov. 28, 2008.

FIELD OF THE INVENTION

The present invention relates to a liquid crystal display (LCD) device, which exhibits an enhanced response speed in a wide temperature range.

BACKGROUND OF THE INVENTION

In a LCD, various voltage signals are applied to LCD elements to change states of liquid crystal so as to change transmittance and gray or color levels. Take a 256-level display as an example, the 256 levels are indicated by 8 bits, and as shown in the plot of FIG. 1, voltage values in the vertical axis respectively corresponding to gray/color levels 0~255 in the horizontal axis are selectively applied to the LCD pixels.

Generally, data are updated every frame in a LCD. Viewing from a single LCD pixel, an applied voltage readily varies with a given level data. However, the response speed of liquid crystal is not definitely quick as well. Response speed is typically defined by a period of time required for achieving 10%~90% of expected luminance from the current luminance.

Generally, response speed significantly decreases in a low-temperature environment. A machine like a vehicular navigation system used in for example Northern Europe even possibly needs to be started in a temperature as low as minus tens of degrees Centigrade. In such a low temperature, liquid crystal is too viscous to be well responsive while starting. Therefore, the resulting image is vague and poor displaying quality is rendered.

A method having been developed for enhancing response speed of liquid crystal is known as "overdrive".

An overdrive method is a technique applying a voltage higher than a voltage determined according to a given data level, e.g. 0~255, to accelerate the change of the LC state. The higher voltage, for example, is a voltage corresponding to a level higher than the given data level.

For precisely controlling overdrive voltages depending on images, another conventional overdrive method is proposed to predict level data for each pixel in the previous frame and then output overdriven level data accordingly, as disclosed in Japanese Patent Publication No. 2005-107531.

Since the overdrive operation in Japanese Patent Publication No. 2005-107531 is updated every frame, and it is known the level change between adjacent frames could be insignificant, the predicted values are likely to have no or almost no change. Then the overdrive effect cannot be seen.

Therefore, the inventor of the present application proposed in a previously filed Japanese patent application No. 2008-111730 a method for enhancing the response speed of a LCD device by utilizing temperature-dependent lookup tables containing predicted levels after a predetermined number of frames. For example, even if molecules are relatively inactive and response speed is relatively low in a low temperature environment, overdrive operations of the same number as the predetermined number of frames can still be performed according to preset overdrive values and the predicted levels after the predetermined number of frames.

However, in the architecture of the previously filed Japanese patent application, control is performed, usually for all the pixels, by calculating drive voltages while referring to predicted values. Furthermore, since all the combinations of levels at the start and the end of the overdrive are required to be kept in the lookup tables for storing overdrive values, the requirement of a relatively large memory capacity would be a problem.

For example, for preparing lookup tables corresponding to 14 levels of temperature from −30° C. to 35° C., including −30, −25, −20, −15, −10, −5, 5, 0, 10, 15, 20, 25, 30 and 35° C., in order to display in a 8-bit grey scale, a memory capacity of 256×256×8×14=7.3 Mbit is required. Once conditions such as display gray scales, temperatures, etc. are set in more levels, even great memory capacity becomes necessary. Cost would be raised accordingly.

In one way, on a condition that the response time of liquid crystal is highly sensitive to temperature, the interval 5° C. of the lookup tables may be too large in some cases. Therefore, once temperature changes dramatically, the switching between different lookup tables would result in a problem of obvious difference in image quality.

Consequently, although it is preferred to perform precise control in response to detailed temperature setting, the limitation in the memory capacity makes it difficult to practice.

Furthermore, for a device such as particularly a LCD TV, due to high-speed motion pictures, the response speed is required to be high. Therefore, driving operations are performed at a speed of two times, four times, etc. However, as the device is generally produced at a room temperature such as 25° C., it is hard to follow by high-speed drive under a temperature drop up to for example 10 degrees. Consequently, it is to be considered whether the feedback control using the above-mentioned lookup tables is proper or not.

With regards to the memory capacity, the above-mentioned Japanese patent application No. 2005-107531 discloses the use of a pair of one-dimensional tables to reduce the memory capacity for storing overdrive values. However, the preset overdrive values cannot exhibit the best performance for display functions of the LCD device.

SUMMARY OF THE INVENTION

Therefore, an object of the present invention is to provide a LCD device whose display quality can be improved by way of precise overdrive control without increasing memory capacity.

For achieving the object, the present invention provides a liquid crystal display device, which includes a LCD module; a thermal sensor disposed in the display module; an operating device calculating and outputting an overdrive voltage of the LCD module and a predicted value of a sub-frame according to a start level and an end level of an image data; and a frame memory storing the predicted value as the start level and outputting it to the operating device. The operating device includes: a first comparator for determining whether the start level and the end level are consistent or not; a one-dimensional first lookup table showing the relationship between gray levels and normalized offsets which are used for standardizing curves represented by squares of voltages corresponding to the gray levels; a one-dimensional second lookup table showing the relationship between levels and squares of voltages corresponding to the gray levels; an operator for obtaining an intermediate output value for overdrive, which correlates to a square of voltage, by referring to the start level, the end level, and values of the first and second lookup tables; a second comparator for determining whether the output of the operator is greater than a predefined maximum, less than a predefined minimum, or is an intermediate value; a one-dimensional third lookup table used for calculating an overdrive value to be referred according to outputs of the first and second comparators; and a one-dimensional fourth lookup table used for calculating a predicted value to be referred according to outputs of the first and second comparator. The first to fourth lookup tables are dynamically updated in response to the value outputted by the thermal sensor. The LCD further includes a selector/data-generator generating an overdrive output and a prediction output according to the outputs of the first comparator, the second comparator and the operator, depending on one of four conditions including: a first condition that the start level and the end level are consistent; a second condition that the intermediate output value for overdrive is greater than the predefined maximum; a third condition that the intermediate output value for overdrive is less than the predefined minimum; and a fourth condition that the intermediate output value for overdrive lies between the predefined maximum and the predefined minimum. The term "gray level(s)" used herein and hereinafter is not limited to the level(s) in grayscale between black and white, but also means color level(s).

According to the present LCD device, due to the use of a square of voltage in one of the coordinates, a plurality of one-dimensional lookup tables may be used to replace the conventional two-dimensional lookup one, whereby the required memory capacity can be reduced so as to cost down. Furthermore, the use of lookup tables corresponding to narrow temperature intervals facilitates adequate overdrive and improves image quality.

BRIEF DESCRIPTION OF THE DRAWINGS

The above contents of the present invention will become more readily apparent to those ordinarily skilled in the art after reviewing the following detailed description and accompanying drawings, in which:

FIG. 4 is a table illustrating contents of a predicted-value lookup table, in which predicted levels corresponding to different start levels are shown for given maximum and minimum overdrive values;

DETAILED DESCRIPTION OF THE PREFERRED EMBODIMENT

Hereinafter, embodiments of the present invention are described with reference to the drawings. The present invention, however, is not limited to those embodiments.

Figure 1:
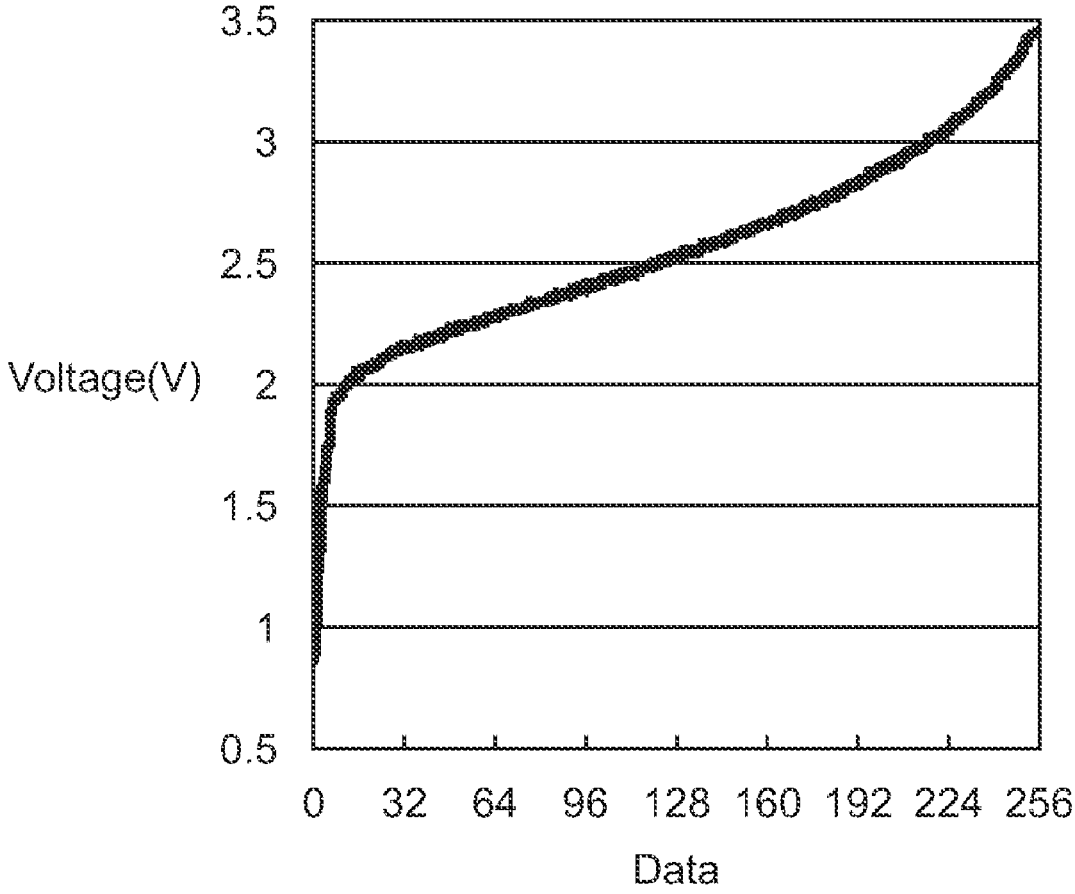
FIG.1 PRIOR ART
FIG. 1 is a plot showing the relationship between data and voltages applied to a LCD element of a LCD device.
Figure 2:
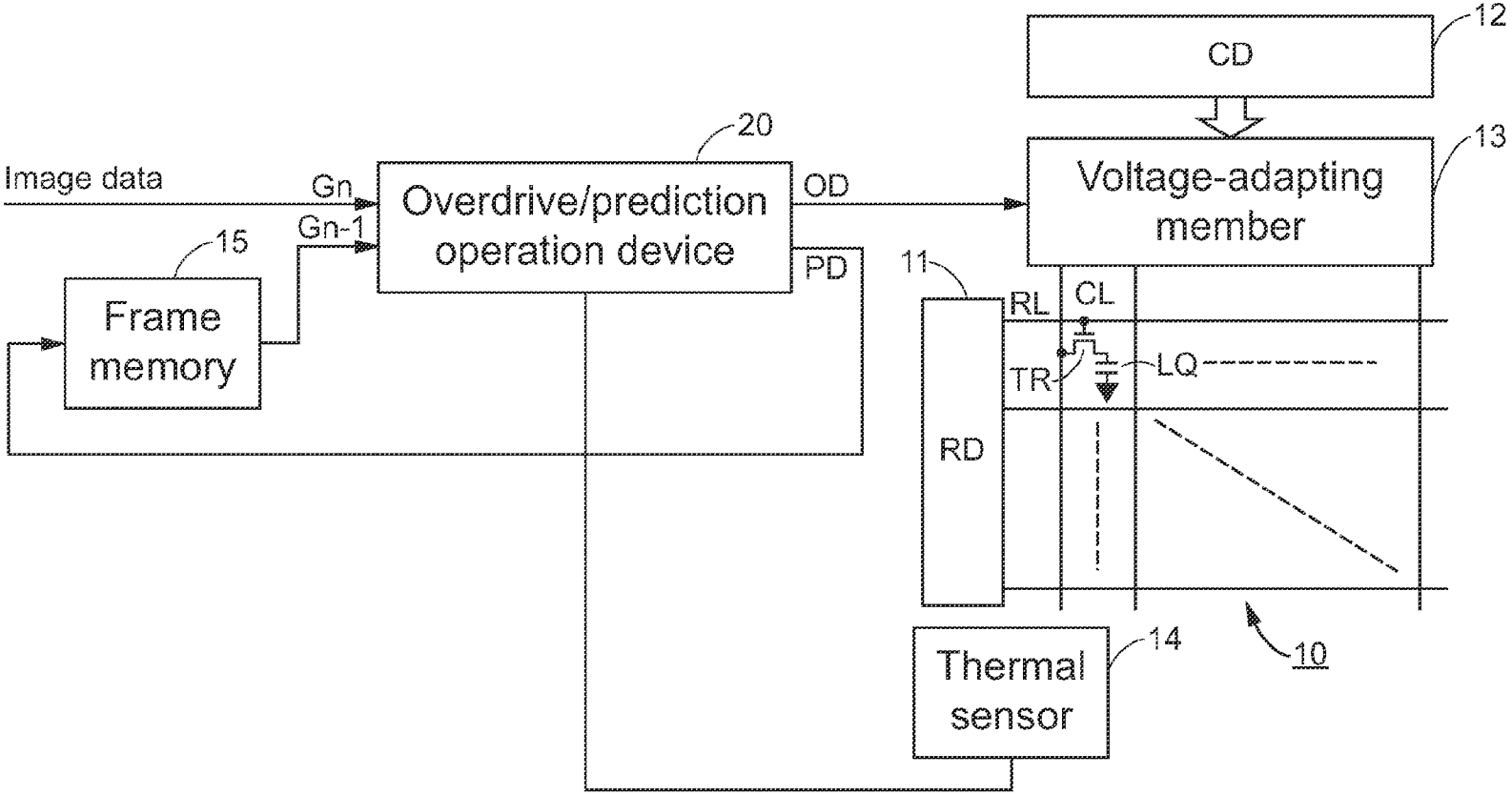
FIG. 2 is a block diagram illustrating a brief architecture of a LCD device according to the present invention.

FIG. 2 is a block diagram illustrating main parts of architecture of a LCD device according to the present invention.

As known, LCD elements LQ are arranged as a matrix to form an LC panel 10 for displaying, for example, a VGA picture consisting of 640×480 pixels. The LCD elements LQ are interconnected through transistors TR, wherein their gates are connected to row lines RL selected by a row decoder 11, and their sources are connected to column lines (data lines) CL controlled by a column decoder 12.

Row lines RL are activated one by one by the row decoder RD for a single line period of time while column lines CL are activated sequentially by the column decoder CD. A voltage-adapting member 13 modifies a voltage applied to a column line CL corresponding to a selected LCD element according to a level data to be displayed so as to change transmittance of liquid crystal by way of changing the voltage to a level corresponding to the level data to be displayed. In the LC panel 10, for determining an ambient temperature, i.e. real temperature of liquid crystal, temperature information acquiring means 14 is disposed for acquiring temperature information. Although the temperature information acquiring means 14 may be any device capable of generating a physical parameter dependent from temperature, it is a thermal sensor used in this embodiment, which determines a direct temperature.

The voltage-adapting member 13 is provided thereto an overdrive value from an overdrive/prediction operation device 20, and the voltage finally provided for each LCD element is a voltage equivalent to a level adapted to overdrive.

The overdrive/prediction operation device 20 receives the output from the thermal sensor 14, and outputs an overdrive value OD and a one-frame-later predicted value PD according to the output from the thermal sensor 14, using input image data as the end level Gn. The predicted value PD serves as the start level Gn−1 of the frame memory 15 and is fed back to the overdrive/prediction operation device 20 to be operated. A frame memory generally stores pixel data of an entire frame. Taking a VGA frame for example, data of 640×480 pixels are included.

Furthermore, there are two kinds of states selectively indicated when no voltage is supplied, i.e. normal black and normal white. In the example of LCD to be described hereinafter, it is normal black defined as level 0.

Figure 3:
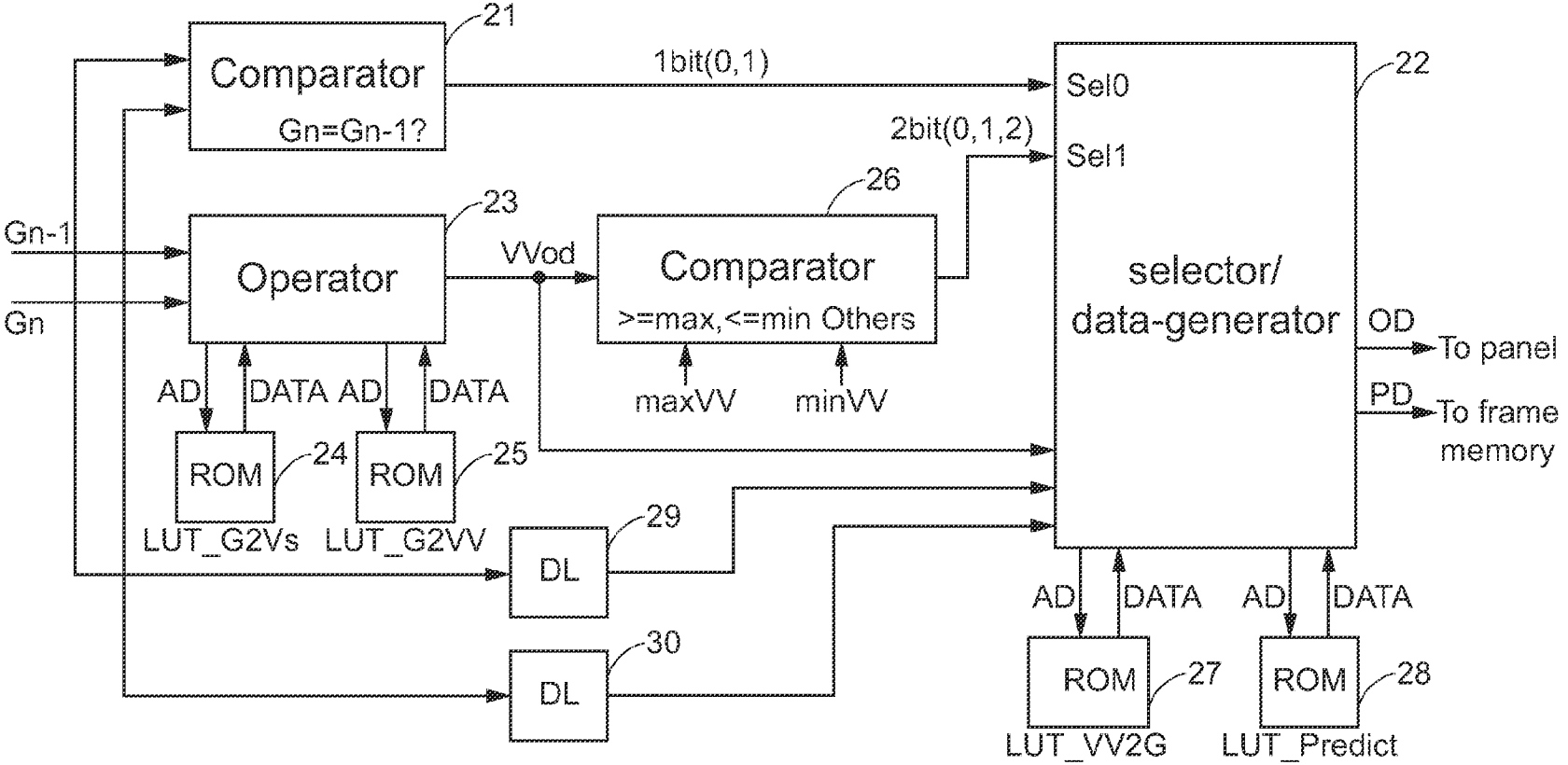
FIG. 3 is a block diagram illustrating a first embodiment of an overdrive/prediction-operation device in FIG. 2.

FIG. 3 is a block diagram illustrating a first embodiment of the structure of an overdrive/prediction-operation device in FIG. 2.

In this example, 60 frames are displayed per second, so it takes about 16.7 ms to input level data for each frame. In the following process, all the pixel data in the same row can be processed at one time or by time division. For easy illustration, however, a single pixel is processed at a time in this example.

A start level Gn−1 and an end level Gn are first inputted into a comparator 21 to be compared. A one-bit output indicating whether these values are the same is inputted into a selector/data-generator 22 as a first selection input Sel0.

The start level Gn−1 and the end level Gn are also inputted into an operator 23. The input values are referred to as addresses for picking up data from two lookup tables LUT_G2Vs and LUT_G2VV. A specified operation is then performed to output an overdrive operation value VVod provided for the selector/data-generator 22 and a comparator 26. These lookup tables will be described later.

The comparator 26 outputs a 2-bit output to a second selection input Sell of the selector/data-generator 22, which is indicative of one of the maximum, the minimum and others of the overdrive value.

The start level Gn−1 and the end level Gn are further inputted into the selector/data-generator 22 via delays 29 and 30 for timing adjustment, respectively. The selector/data-generator 22 refers to the two lookup tables LUT_VV2G and LUT_Predict, and outputs final overdrive value OD and predicted value PD according to the five inputs. The overdrive value OD and predicted value PD are then sent to the LC panel 10 and the frame memory 15, respectively.

Hereinafter, constructions of the lookup tables are described. It is to be noted that memory contents corresponding to a specified temperature, e.g. −10° C., are described in the following. If used in an area at an extremely low temperature, the lookup tables need be changed as the properties of liquid crystal change significantly. Lookup tables may be made at intervals of, for example, 5° C.

Figure 5:
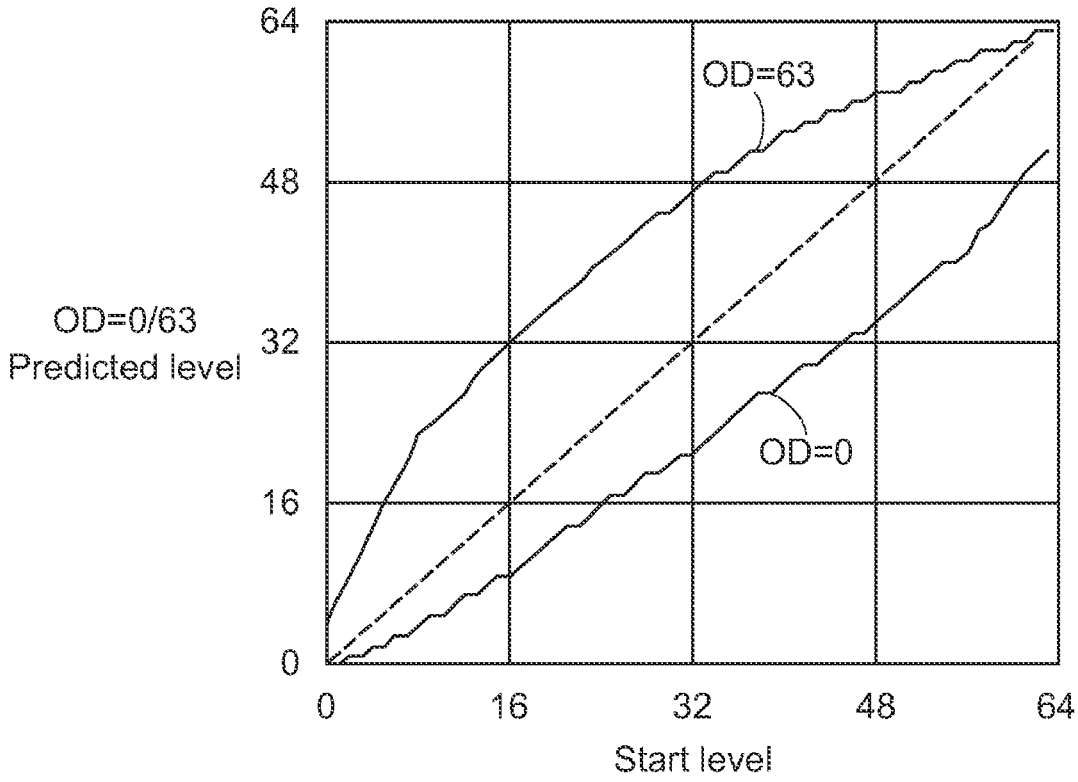
FIG. 5 is a plot showing the data associated with FIG. 4.

The values of the lookup tables in a basic example of the present invention at a temperature of −10° C. are shown in the table of FIG. 4 and the plot of FIG. 5. They are described as 64 levels 0~63.

As shown in FIG. 4, the left column indicates start levels, the middle column indicates predicted levels in one frame later with the overdrive value being the minimum value 0, and the right column indicates predicted levels in one frame later with the overdrive value being the maximum value 63.

For example, if the start level is 0, i.e. black, the predicted level in one frame later increases up to 4 in spite the maximum overdrive value is 63 at this temperature. Accordingly, the overdrive value is set to be 63 for predicted levels greater than 4. On the other hand, if the start level is 63, i.e. white, the predicted level in one frame later decreases as low to 51 in spite the minimum overdrive value is 0 at this temperature. Accordingly, the overdrive value is set to be 0 for predicted levels less than 51.

Therefore, in the plot of FIG. 5, an overdrive value 63 is adopted for predicted levels higher than the upper solid curve, while an overdrive value 0 is adopted for predicted levels lower than the lower solid curve. In the area between the curves, overdrive values are determined according to an algorithm to be described later.

In other words, with two one-dimensional lookup tables as shown in FIG. 4, which correspond to two solid lines of FIG. 5, the values can be used to determine overdrive values and predicted values.

The data indicated by the solid lines of FIG. 5 are stored in the lookup table LUT_Predict 28 of FIG. 3. The data contents stored in the lookup table include only data of two curves instead of 64-level matrix data as in the prior art. Data quantity becomes $2/64=1/32$ of the conventional one and thus the required memory capacity is significantly reduced. For a LCD with 256-level display, the required memory capacity is further reduced to $1/128$.

Figure 6:
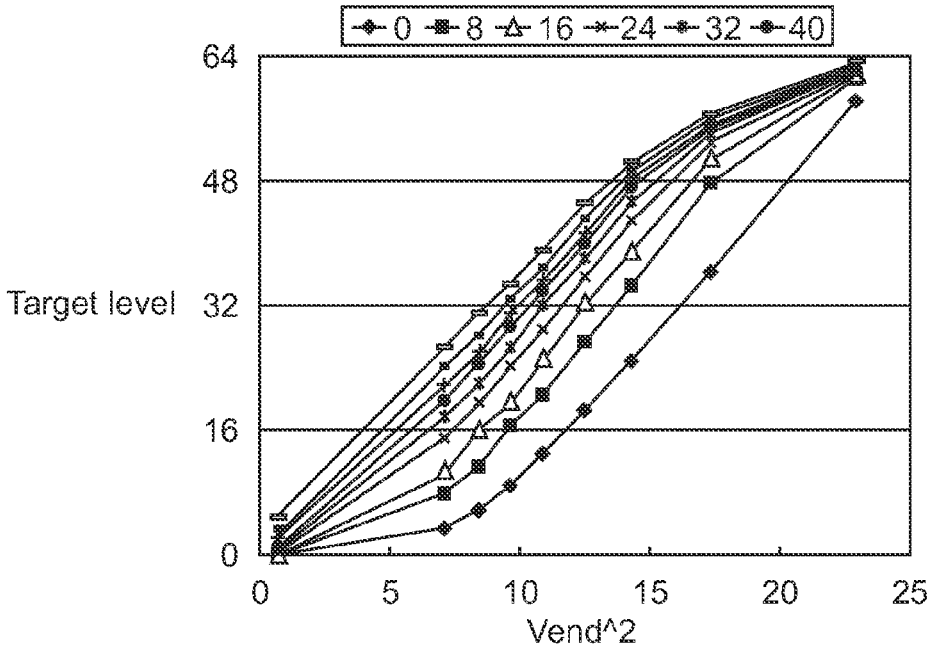
FIG. 6 is a plot showing curves of a variety of start levels, wherein the abscissa indicates values of squares of voltage finally applied to a LCD element and the ordinate indicates levels to be achieved (target level)

Furthermore, the present inventor found that using overdrive values as parameters, a plot can be made with a square of voltage applied to liquid crystal in the abscissa and a level to be achieved one frame later in the ordinate, as shown in FIG. 6. In spite of different overdrive values, the configurations of the curves are similar. In particular, the middle sections of the curves are substantially linear with almost the same slopes.

Figure 7:
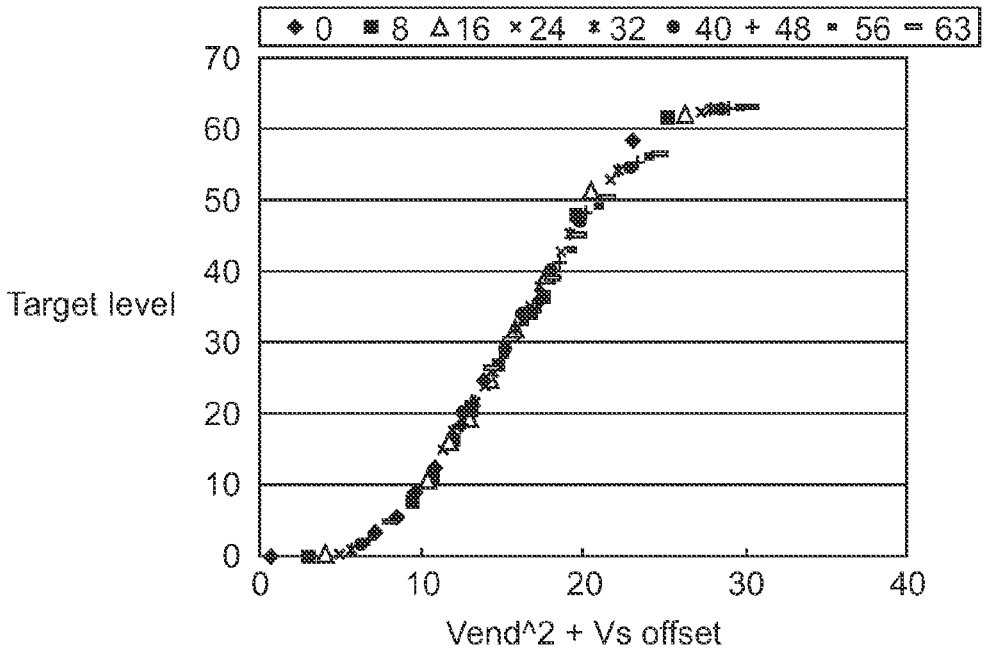
FIG. 7 is a plot showing a curve obtained by providing offsets to the lines as shown in FIG. 6.

Therefore, with proper offset, shift in the abscissa can be rendered. As a result, all the characteristic curves of levels to be reached conform to one curve, as shown in FIG. 7. In brief, the plot indicates that the level to be reached one frame later can be predicted if the square of voltage applied to liquid crystal, i.e. Ve^2, and the offset voltage Vsoffset corresponding to the state of liquid crystal immediately before the application of voltage, i.e. the start level, are known. It is the basic idea of the present invention.

Furthermore, the correlation as shown in FIG. 7 has been confirmed that it is applicable to a wide range of operational temperature of liquid crystal.

Next, lookup tables used in FIG. 3 are described.

Figure 8:
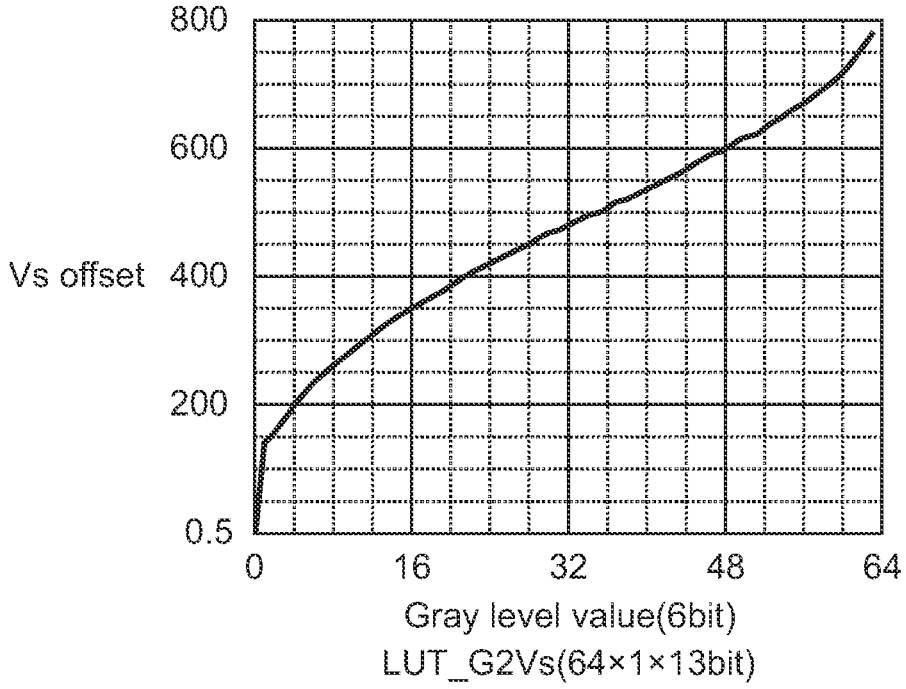
FIG. 8 is a plot showing storage contents of the lookup table LUT_G2Vs in FIG. 3.

FIG. 8 is a plot illustrating data stored in LUT_G2Vs 24. Since relationship of offset voltage Vsoffset in the ordinate versus 6-bit gray level in the abscissa is shown, it is one-dimensional lookup table. Furthermore, there is no specific unit for the ordinate. Instead, relative values are expressed for comparison only. In other words, the plot shows degrees of offset corresponding to different overdrive levels in a relative manner.

Figure 9:
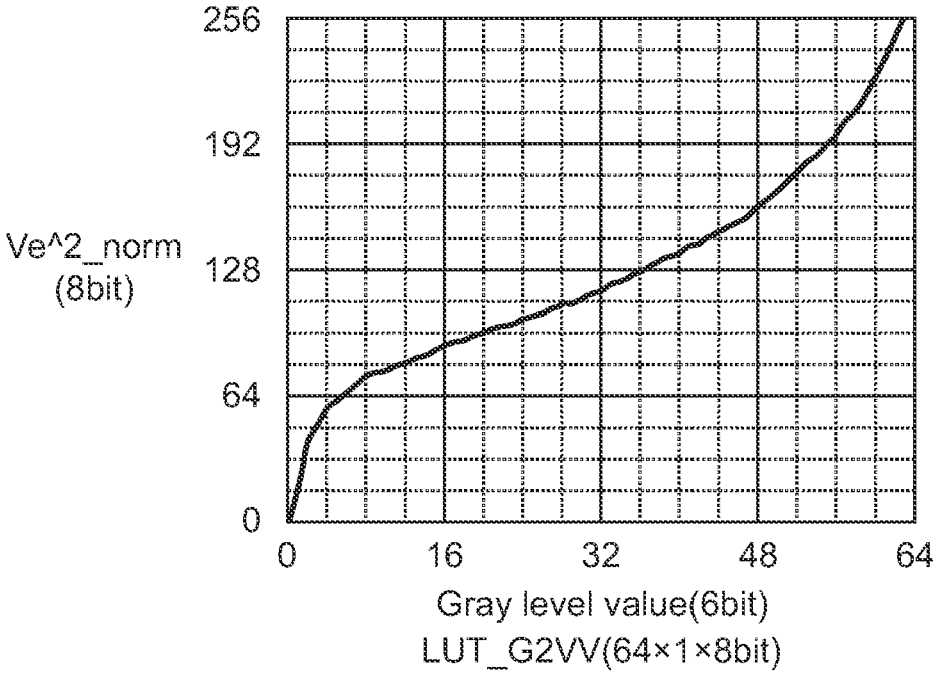
FIG. 9 is a plot showing storage contents of the lookup table LUT_G2VV in FIG. 3.
Figure 10:
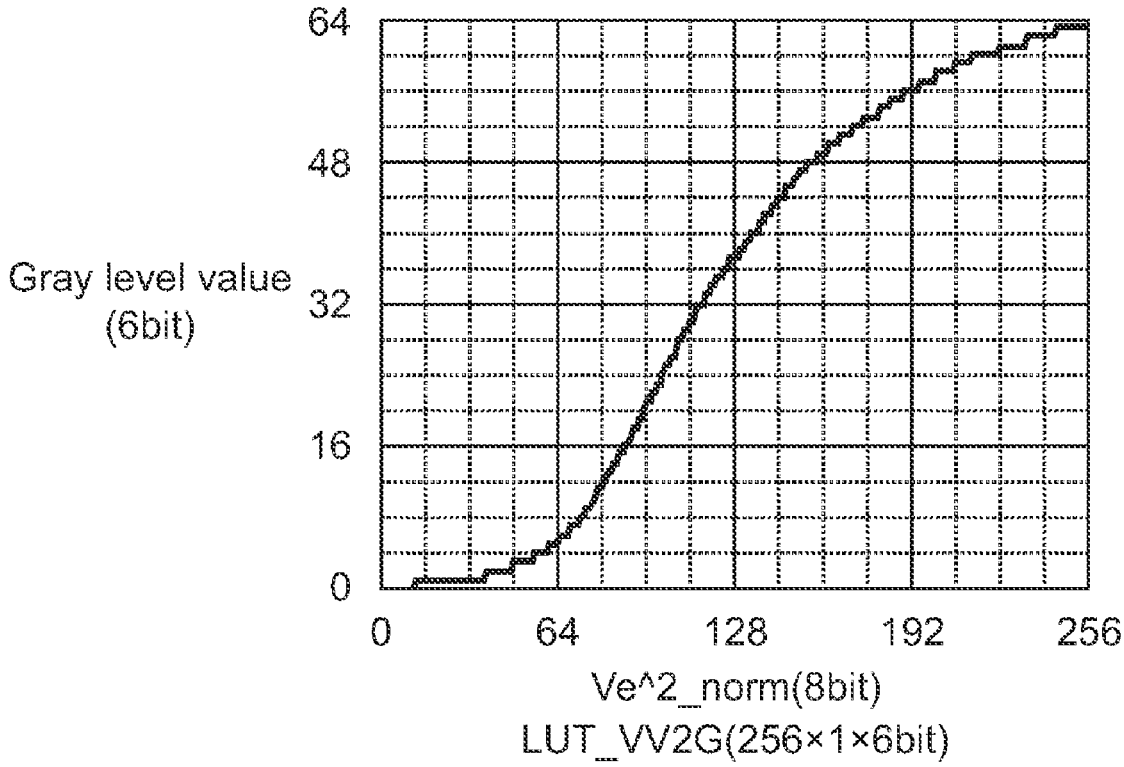
FIG. 10 is a plot showing storage contents of the lookup table LUT_VV2G in FIG. 3.

FIG. 9 is a plot illustrating data stored in LUT_G2VV 25. The abscissa indicates 6-bit gray level while the ordinate indicates square of normalized voltage Ve^2 (8-bit). FIG. 10 is a plot associated with the lookup table LUT_VV2G 27, whose abscissa and ordinate are replaced with each other compared to the lookup table LUT_G2VV 25. Both lookup tables are one-dimensional.

Figure 11:
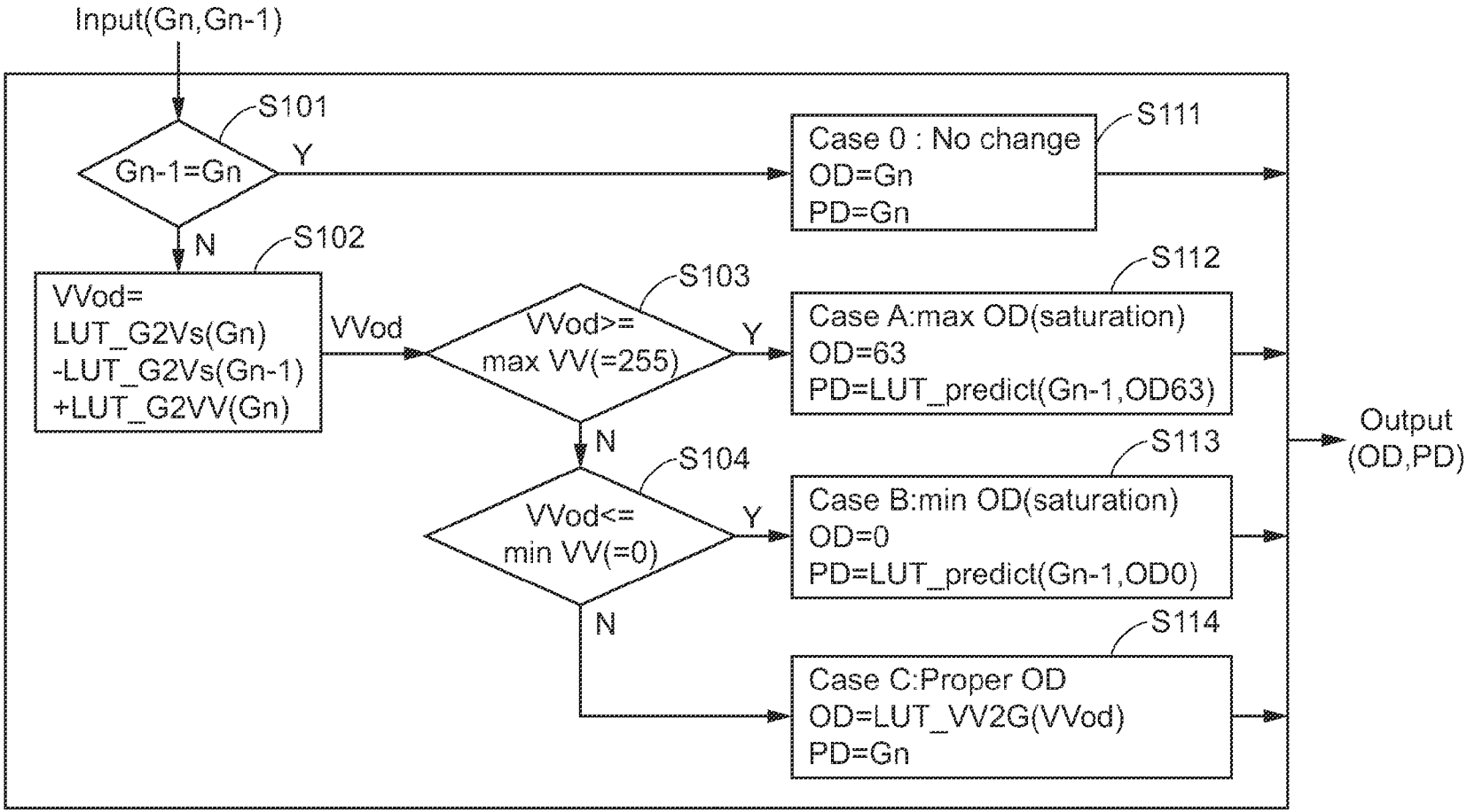
FIG. 11 is a flowchart illustrating operations of the architecture of FIG. 3.

Subsequently, the operations of the architecture of FIG. 3, in which these lookup tables are used, are illustrated in FIG. 11.

When the start level Gn−1 and the end level Gn are inputted, the comparator 21 compares these values to determine whether they are the same or not (Step S101). Once they are the same (Case 0), Gn is outputted as the overdrive value OD and Gn is outputted as the predicted level value PD (Step S111).

In a case that the start level Gn−1 and the end level Gn are not the same, the operator 23 calculates VVod=LUT_G2Vs (Gn)−LUT_G2Vs (Gn−1)+LUT_G2VV (Gn) (Step S102) with reference to the lookup tables LUT_G2Vs 24 and LUT_G2VV 25, and provides VVod for the comparator 26 and also sends it to the selector/data-generator 22.

VVod used herein is a value expressed as a square of normalized voltage applied to liquid crystal for the required overdrive value.

In the comparator 26, the VVod value, a maximum VV value (Max VV) and a minimum VV value (Min VV) are compared (Step S103, Step S104). If the VVod value is greater than the maximum VV value, i.e. in Case A indicating saturate maximal overdrive, 63 is outputted as the overdrive value OD, and a value corresponding to Gn−1 and the overdrive value 63 is read from the lookup table LUT_Predict and outputted as the predicted level value PD (Step S112). On the other hand, if the VVod value is smaller than the minimum VV value, i.e. in Case B indicating saturate minimal overdrive, 0 is outputted as the overdrive value OD, and a value corresponding to Gn−1 and the overdrive value 0 is read from the lookup table LUT_Predict and outputted as the predicted level value PD (Step S113).

If the VVod value lies between the maximum VV value (Max VV) and the minimum VV value (Min VV), it is Case C indicating proper overdrive. Meanwhile, the overdrive value OD corresponding to the VVod value is read from the lookup table LUT_VV2G 27 and Gn is outputted as the predicted level value PD (Step S114).

In this embodiment, all the lookup tables are one-dimensional. While the capacity of the lookup tables is reduced, control with high precision is feasible.

A second embodiment of the present invention will be described with reference FIG. 12 through FIG. 18.

Figure 12:
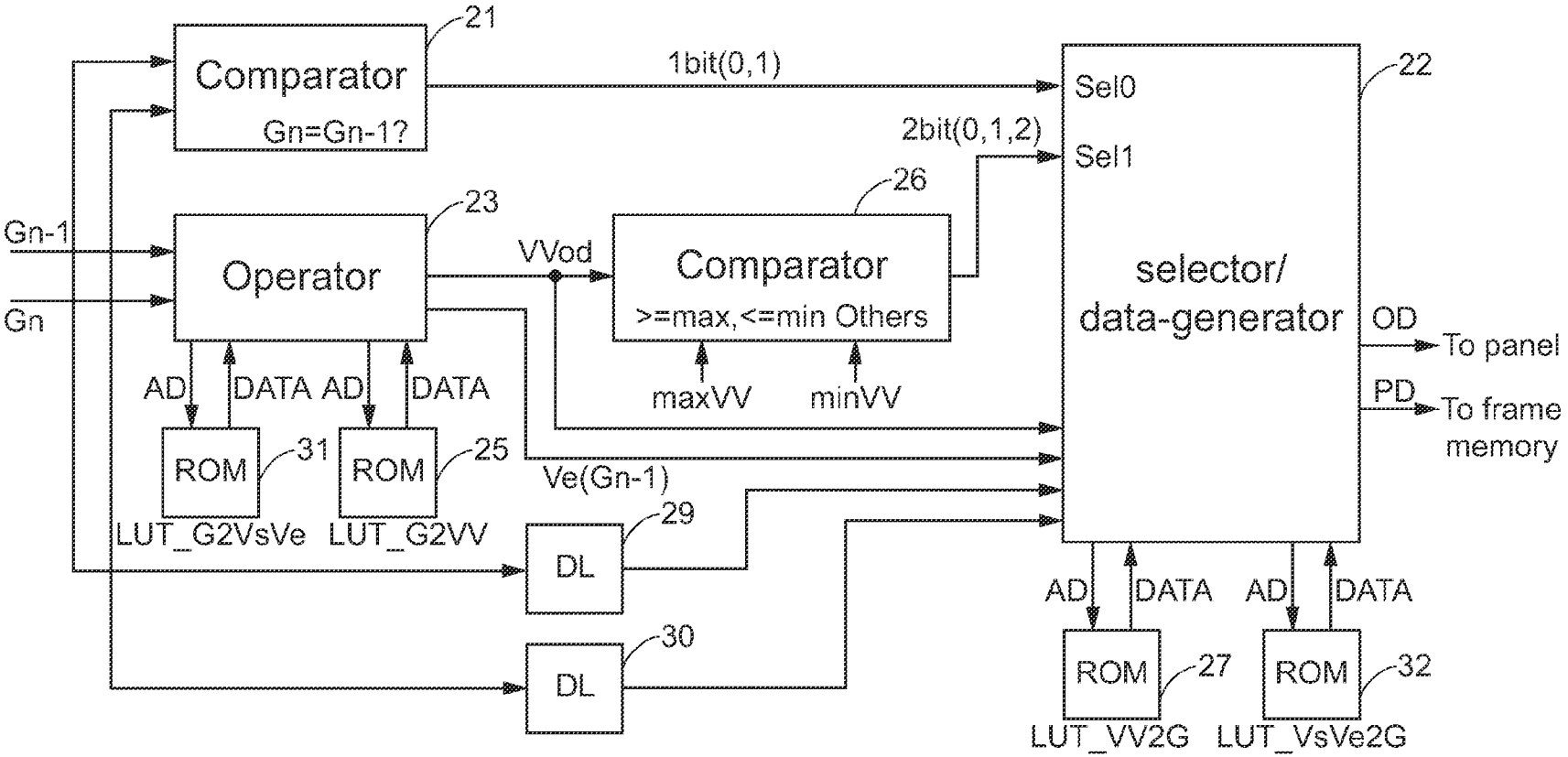
FIG. 12 is a block diagram illustrating a second embodiment of an overdrive/prediction-operation device in FIG. 2.

FIG. 12 is a block diagram illustrating the structure of a second embodiment of an overdrive/prediction-operation device in FIG. 2.

Since the structure of the second embodiment is similar to that of the first embodiment shown in FIG. 3, the descriptions of the common elements are omitted.

The differences from the embodiment of FIG. 3 include the use of LUT_G2VsVe 31 in lieu of LUT_G2Vs 24 and LUT_G2VV 25 as the lookup tables to be referred for generating the output VVod, and the use of LUT_VV2G 27 and LUT_VsVe2G 32 in lieu of LUT_Predict 28 as the lookup tables to be referred for generating the drive value OD and the predicted level value PD.

Figure 13:
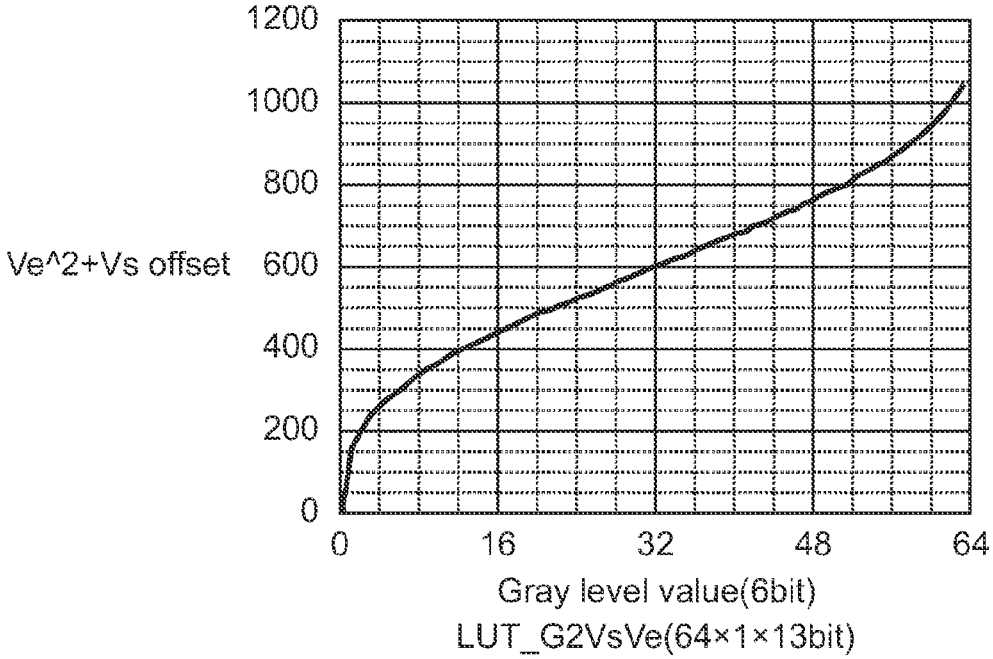
FIG. 13 is a plot showing storage contents of the lookup table LUT_G2VsVe in FIG. 12.
Figure 14:
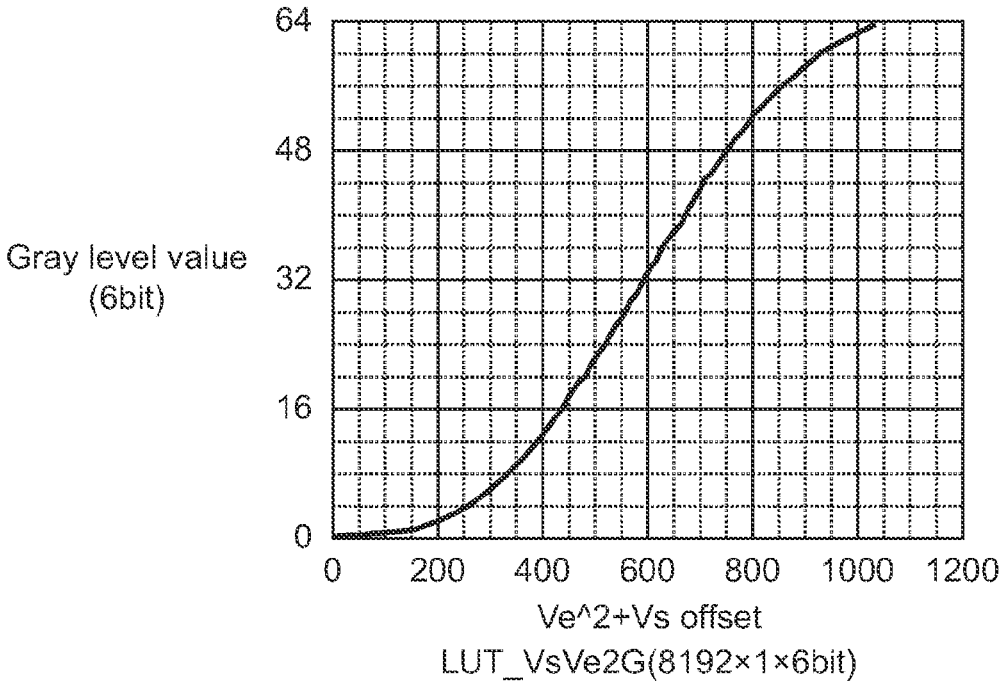
FIG. 14 is a plot showing storage contents of the lookup table LUT_VsVe2G in FIG. 12.

The storage contents of the lookup table LUT_G2VsVe 31 is illustrated in FIG. 13, and the storage contents of the lookup table LUT_VsVe2G 32 is illustrated in FIG. 14.

The abscissa of LUT_G2VsVe 31 shows gray level values from 0 to 63, and the ordinate shows values of Ve^2 plus applied voltage offset Vsoffset. It has a size of 64×1×13 bits.

In other words, the correlation LUT_G2VsVe=LUT_G2VV+LUT_G2Vs stands.

The plot of the lookup table LUT_VsVe2G 32 shown in FIG. 14 has its abscissa and ordinate exchanged relative to the abscissa and ordinate of the lookup table LUT_G2VsVe 31 shown in FIG. 13. It has a size of 8192 (equivalent to 13 bits)×1×6 bits. Furthermore, the amount of 13 bits is used in consideration of an operational temperature range as low to −30 degrees. If a narrower operational temperature range (relatively high temperature) is considered, a smaller amount of bits can be used.

Figure 15:
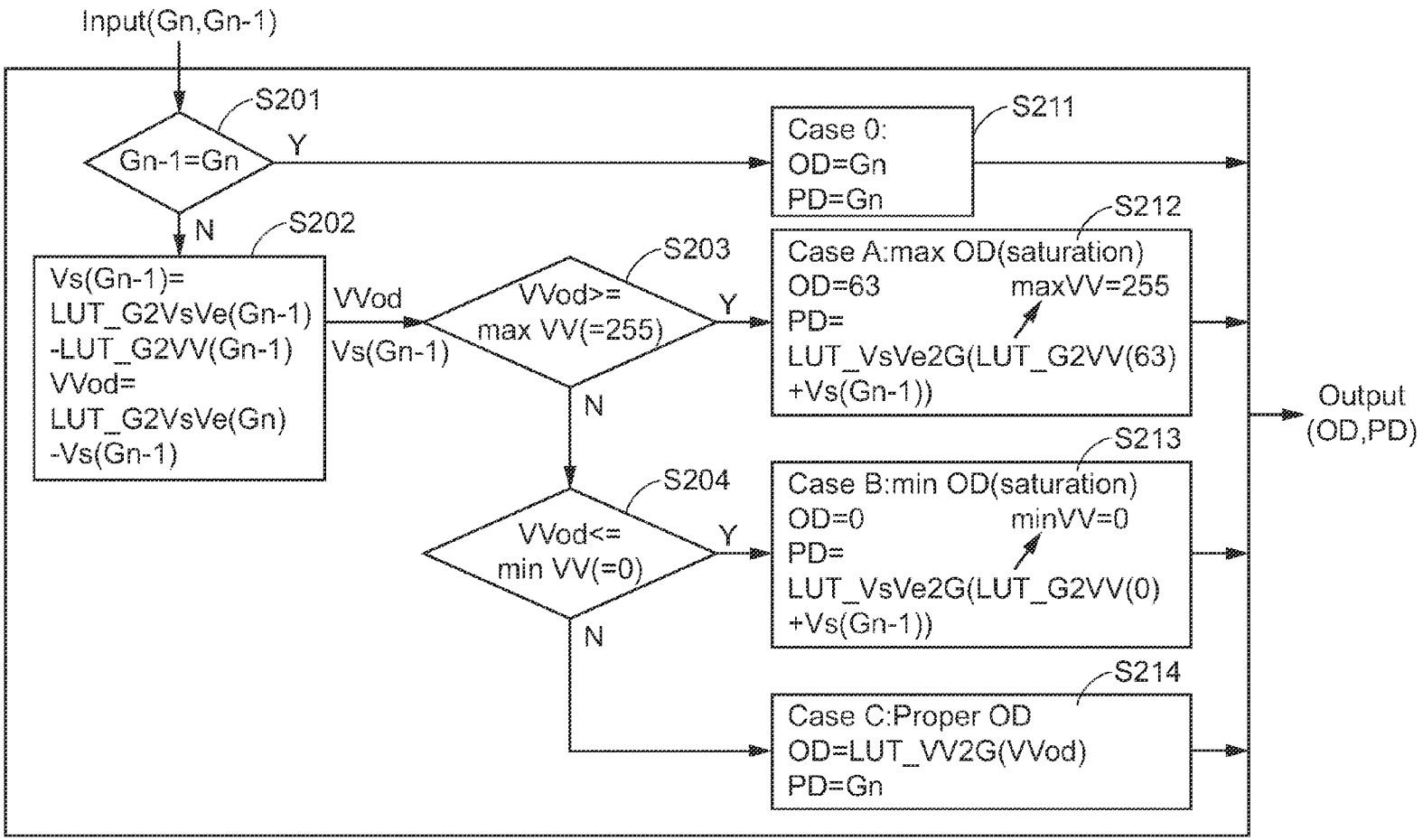
FIG. 15 is a flowchart illustrating operations of the architecture of FIG. 12.

FIG. 15 corresponds to FIG. 11 in the first embodiment and is a flowchart illustrating operations of the architecture of FIG. 12.

When the start level Gn−1 and the end level Gn are inputted, the comparator 21 compares these values to determine whether they are the same or not (Step S201). Once they are the same (Case 0), Gn is outputted as the overdrive value OD and Gn is outputted as the predicted level value PD (Step S211).

In a case that the start level Gn−1 and the end level Gn are not the same, the operator 23 first calculates Vs (Gn−1)=LUT_G2VsVe (Gn−1)−LUT_G2VV (Gn−1) with reference to the lookup tables LUT_G2VsVe 31 and LUT_G2VV 25, and then calculates VVod=LUT_G2VsVe (Gn)−Vs (Gn−1). While both of the calculated results are provided to the selector/data-generator 22, only VVod is sent to the comparator 26 (Step S202).

In the comparator 26, the VVod value, a maximum VV value (Max VV) and a minimum VV value (Min VV) are compared (Step S203, Step S204). If the VVod value is greater than the maximum VV value, i.e. in Case A indicating saturate maximal overdrive, 63 is outputted as the overdrive value OD, and LUT_VsVe2G (LUT_G2VV (63)+Vs (Gn−1)) is outputted as the predicted level value PD (Step S212).

On the other hand, if the VVod value is smaller than the minimum VV value, i.e. in Case B indicating saturate minimal overdrive, 0 is outputted as the overdrive value OD, and LUT_VsVe2G (LUT_G2VV (0)+Vs (Gn−1)) is outputted as the predicted level value PD (Step S213).

If the VVod value lies between the maximum VV value (Max VV) and the minimum VV value (Min VV), it is Case C indicating proper overdrive. Meanwhile, a gray level value converted from a square of normalized voltage value according to the lookup table LUT_VV2G (VVod) is outputted as the overdrive value OD, and Gn is outputted as the predicted level value PD (Step S214).

All the lookup tables used in this embodiment are also one-dimensional. While the capacity of the lookup tables is reduced, control with high precision is feasible.

Figure 16:
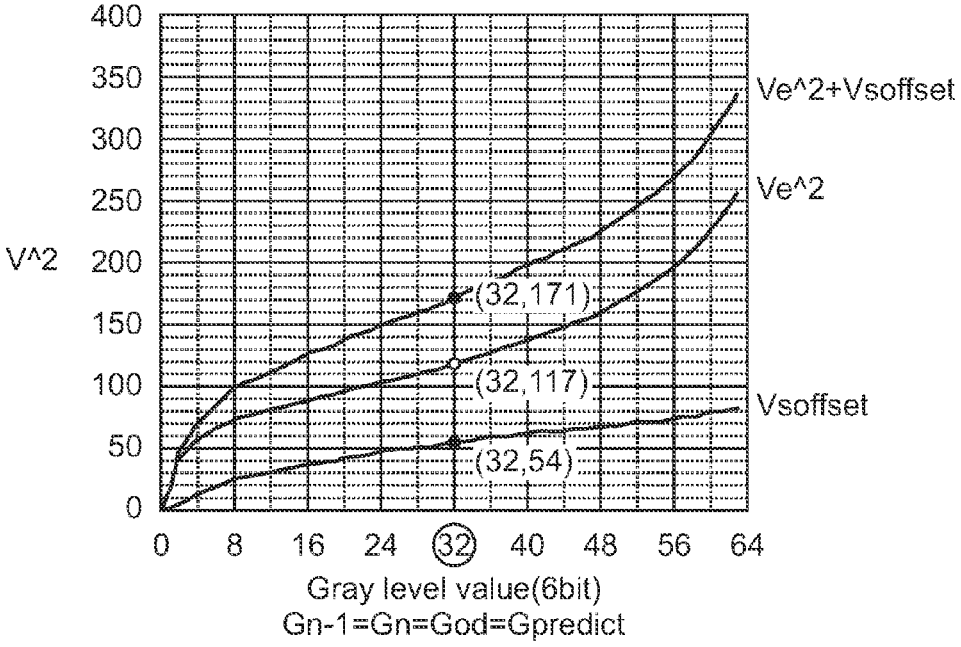
FIG. 16 is a plot illustrating operations of the architecture of FIG. 12 wherein the start level and end level are unchanged.
Figure 17:
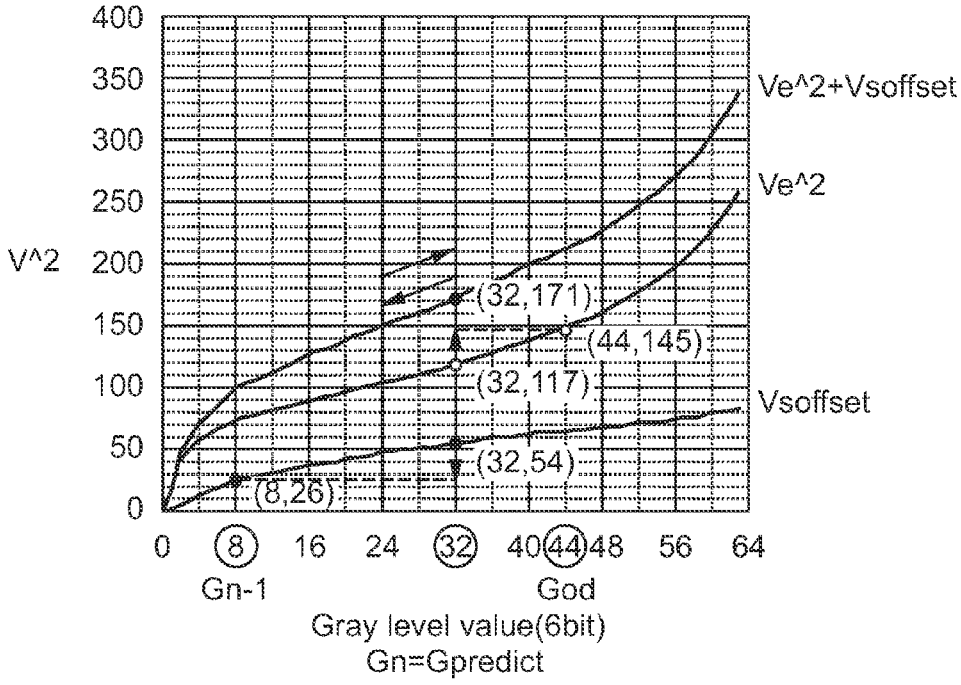
FIG. 17 is a plot illustrating operations of the architecture of FIG. 12 wherein the change from a start level toward an end level is suitable for an overdrive voltage.
Figure 18:
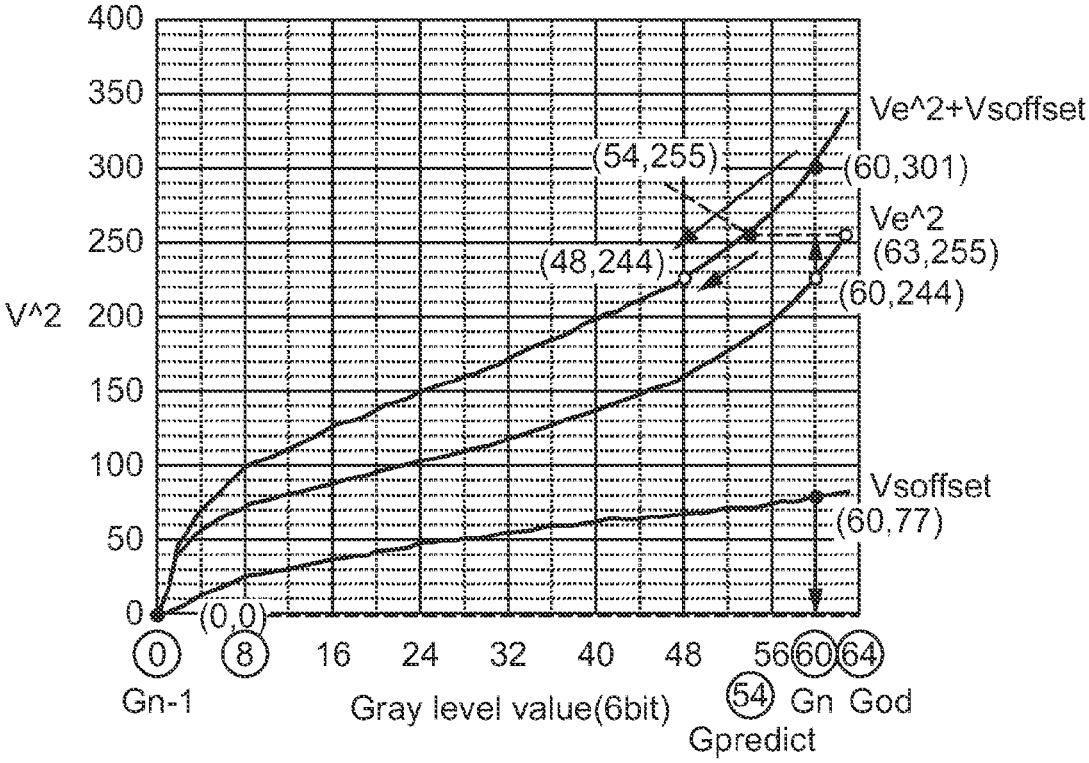
FIG. 18 is a plot illustrating operations of the architecture of FIG. 12 wherein the change from a start level toward an end level is beyond an output range of an overdrive voltage.

The plots as shown in FIG. 16 through FIG. 18 sequentially illustrate the realization of start level Gn−1, end level Gn, overdrive value God and predicted value Gpredict according to three curves representing Vsoffset, a square of normalized end voltage Ve, i.e. Ve^2 (=VV), and a sum of these values, i.e. Ve^2+Vsoffset (=VsVe). The symbol V indicates a voltage-related value and G indicates a gray level value.

As described above, the storage contents of the lookup table LUT_G2Vs 24 are Vsoffset values; the storage contents of the lookup table LUT_G2VV 25 are Ve^2 values; and the storage contents of the lookup table LUT_G2VsVe 31 are (Ve^2+Vsoffset) values.

FIG. 16 illustrates the case that the start level Gn−1 and the end level Gn are the same (Gn=Gn−1=32).

In this case, the overdrive value OD and the predicted level value in FIG. 11 and FIG. 15 are both Gn, so Gn−1=Gn=God=Gpredict, and the equation God=Gpredict=32 is previously determined without referring to ordinate values of the curves.

Furthermore, this case defines storage contents of the lookup table LUT_G2VsVe 31. In other words, a sum of a Vsoffset value and a Ve^2 value corresponding to each level is a value on Ve^2+Vsoffset corresponding to the same level.

In FIG. 16, a value "54" is picked up from the lookup table LUT_G2Vs 24 and a value "117" is picked up from the lookup table LUT_G2VV 25, corresponding to a level value "32", and the sum "171" is a value in the lookup table LUT_G2VsVe 31 corresponding to the level value "32". Thereafter, the lookup table LUT_G2VsVe 31 is made by referring to two lookup tables associated with each level:

$$\text{LUT_}G2VsVe(x)=\text{LUT_}G2Vs(x)+\text{LUT_}G2VV(x),$$

where x is any of the gray level values 0~63. Then the Vsoffset value can be realized after the lookup table is produced according to the two lookup tables LUT_G2VsVe 31 and LUT_G2VV 25. As illustrated in FIG. 12, the lookup table LUT_G2Vs 24 is not required.

FIG. 17 illustrates a case that the start level Gn−1 and the end level Gn are properly separate from each other, e.g. the start level Gn−1 is 8 and the end level Gn is 32. This corresponds to Case C, i.e. proper OD, in FIG. 11 and FIG. 15.

First of all, the point (32, 171) on the curve Ve^2+Vsoffset is referred to. In order to obtain the end level 32 of this point, it is required that Ve^2+Vsoffset=171. Next, referring to a point (8, 26) on the curve Vsoffset, it is realized that the Vsoffset value corresponding to the start level Gn−1=8 is 26. Accordingly, the Ve^2 value essential to overdrive is the residue of 171−26=145 (=VVod), which indicates the point (44, 145) when referring to the curve Ve^2. That is, the overdrive level value God is 44. Furthermore, since the predicted level value is equal to the end level value, Gpredict=Gn=32.

The matters are further described with comparison to FIG. 16. First of all, since the start level Gn−1 changes from 32 to 8, the Vsoffset value changes from 54 toward 26 with a difference of −28. If it is to be compensated with the Ve^2 value, the Ve^2 value needs to increase with an amount of +28. In other words, Ve^2=117+28=145 is desirable. Meanwhile, the level value 44 represents God. As such, the Ve^2+Vsoffset value remains kept constant for balance so as to reach the same end level Gn.

Accordingly, it is not necessary to obtain the predicted level value by way of calculation in the case of proper OD because Gpredict=Gn is constantly applied.

FIG. 18 illustrates a case of maximum overdrive, wherein the start level Gn−1 is 0 and the end level Gn is 60. It is Case A in FIG. 11 and FIG. 15.

First of all, the point (60, 301) on the curve Ve^2+Vsoffset is referred to. In order to obtain the end level 60 of this point, it is required that Ve^2+Vsoffset=301. Correspondingly, referring to a point (0, 0) on the curve Vsoffset, it is realized that the Vsoffset value corresponding to the start level Gn−1=0 is 0. Accordingly, the Ve^2 value essential to overdrive is the residue of 301−0=301 (=VVod). Meanwhile, referring to a point (63, 255) on the curve Ve^2, the maximal Ve^2 value (maxVV) is 255 when God is 63. That is, the difference of 301−255=46 cannot be offset even if the overdrive level value is the maximum (VVod>maxVV). Then 63 is outputted as the maximum overdrive value God. Furthermore, according to the point, i.e. Ve^2+Vsoffset=0+255=255, on the curve Ve^2+Vsoffset, the predicted level value is 54 (Gpredict≠Gn).

The matters are further described with comparison to the case of Gn=Gn−1=60. First of all, since the start level Gn−1 changes from 60 to 0, the Vsoffset value changes from 77 toward 0 with a difference of −77. It is required to be compensated with the Ve^2 value. Therefore, it is desirable to change Ve^2 from 224 to 301, i.e. +77. Since the maximum (maxVV) of the Ve^2 value is 255 but only 255-225=+31 is available for compensation, it is infeasible to reach the end level Gn.

Calculations performed as described in FIG. 16 to FIG. 18 hereinbefore are now shown with formulae using lookup tables:

$$VVod = \text{LUT_G2VsVe}(Gn) - \text{LUT_G2Vs}(Gn-1) \qquad \text{Embodiment 2}$$

$$= \text{LUT_G2Vs}(Gn) + \text{LUT_G2VV}(Gn) - \text{LUT_G2Vs}(Gn-1). \qquad \text{Embodiment 1}$$

The transformed formula from Embodiment 2 to Embodiment 1 is used for substitution into the above-mentioned equations. Then, $$OD = \text{LUT_VV2G}(VVod) \quad (\text{when } 0 < VVod < 255) \qquad \text{Embodiment 2}$$
$$= 63 \ (\text{when } VVod >= 255)$$
$$= 0 \ (\text{when } VVod <= 0)$$

$$PD = \text{LUT_VsVe2G}\begin{pmatrix} \text{LUT_G2V2}(Gn-1) + \\ \text{LUT_G2VV}(OD) \end{pmatrix}$$

$$= \text{LUT_VsVe2G}\begin{pmatrix} \text{LUT_G2VsVe}(Gn-1) - \\ \text{LUT_G2VV}(Gn-1) + \\ \text{LUT_G2VV}(OD) \end{pmatrix}.$$

The aforementioned equation is also used in the above transformed formula. Furthermore, although PD is determined based on two parameters Gn−1 and OD, it is not necessary to realize the predicted level value by way of calculation when OD lies between 0 and 63 since the predicted level value is consistent to the end level, i.e. PD=Gn. On the other hand, on the conditions of OD=0 and OD=63, calculation can be simplified with two one-dimensional lookup tables by way of previously calculating the predicted level value only. That is, $$PD = \text{LUT_predict}(Gn-1, OD0/OD63) \qquad \text{Embodiment 1.}$$

By way of adopting a lookup table with a coordinate including a square of voltage, the architecture is simplified as well as the calculation.

It is known that liquid crystal has a thermal property significantly changing with temperature. Therefore, the reduced amount of memory capacity can be distributed by patterning lookup-table temperatures in detail although the above embodiments adopt 5° C. as an interval of temperatures.

It is to be noted that the above descriptions are only for illustrations of embodiments. Those skilled in the art may do general modifications and/or replacements for the embodiments, which are still covered in the scope of the present invention.

The above-described LCD according to the present invention can be applied to a variety of electronic apparatus such as mobile phones, digital cameras, personal digital assistants (PDAs), vehicular displays, aviatic displays, digital photo frames, portable DVD players, etc., particularly at a low temperature.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A liquid crystal display (LCD) device, comprising:

a LCD module;

a thermal sensor, disposed in the display module;

an operating device calculating and outputting an overdrive voltage and a predicted value of a sub-frame of the LCD module according to a start level and an end level of an image data; and a frame memory storing the predicted value as the start level which is then outputted to the operating device;

wherein the operating device comprises:

a first comparator for determining whether the start level and the end level are consistent or not;

a first lookup table being one-dimensional and showing the relationship between levels and normalized offsets which are used for standardizing curves associated with squares of voltages corresponding to the levels;

a second lookup table being one-dimensional and showing the relationship between levels and squares of voltages corresponding to the levels;

an operator for obtaining an intermediate output value for overdrive, which correlates to a specified square of voltage, by referring to the start level, the end level, and values of the first and second lookup tables;

a second comparator for determining whether an output of the operator is greater than a predefined maximum, is less than a predefined minimum, or is an intermediate value;

a third lookup table being one-dimensional and used for calculating an overdrive value to be referred to according to outputs of the first and second comparators; and a fourth lookup table being one-dimensional and used for calculating a predicted value to be referred to according to the outputs of the first and second comparator; and wherein the first to fourth lookup tables are dynamically updated in response to a value outputted by the thermal sensor; and the LCD device being characterized in comprising a selector/data-generator which differentially generates an overdrive output and a prediction output according to the outputs of the first comparator, the second comparator and the operator, depending on one of four conditions including:

a first condition that the start level and the end level are consistent;

a second condition that the intermediate output value for overdrive is greater than the predefined maximum;

a third condition that the intermediate output value for overdrive is less than the predefined minimum; and a fourth condition that the intermediate output value for overdrive lies between the predefined maximum and the predefined minimum.

2. The LCD device according to claim 1 wherein the second lookup table stores therein squares of voltages corresponding to levels, which are normalized and applied to liquid crystal, and the third lookup table stores therein levels corresponding to squares of voltages which are normalized and applied to liquid crystal.

3. The LCD device according to claim 2 wherein the fourth lookup table stores therein the relationship between start levels and prediction levels.

4. The LCD device according to claim 2 wherein the first lookup table shows the addition of normalized offsets to squares of voltages as defined in the second lookup table corresponding to levels, and the abscissa and ordinate of the fourth lookup table are obtained by switching the abscissa and ordinate of the first lookup table.

5. The LCD device according to claim 1 wherein the fourth lookup table stores therein the relationship between start levels and prediction levels.

6. The LCD device according to claim 1 wherein the first lookup table shows the addition of normalized offsets to squares of voltages as defined in the second lookup table corresponding to levels, and the abscissa and ordinate of the fourth lookup table are obtained by switching the abscissa and ordinate of the first lookup table.

* * * * *